US009983513B2

(12) United States Patent
Nagashima et al.

(10) Patent No.: US 9,983,513 B2
(45) Date of Patent: May 29, 2018

(54) DEVELOPING DEVICE AND IMAGE FORMING APPARATUS INCLUDING THE SAME

(71) Applicant: KYOCERA Document Solutions Inc., Osaka-shi (JP)

(72) Inventors: Teruhiko Nagashima, Osaka (JP); Hiromu Matsumoto, Osaka (JP); Hidenori Takenaka, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days. days.

(21) Appl. No.: 15/585,526

(22) Filed: May 3, 2017

(65) Prior Publication Data

US 2017/0336734 A1 Nov. 23, 2017

(30) Foreign Application Priority Data

May 23, 2016 (JP) ..... 2016-102328

(51) Int. Cl.
*G03G 15/08* (2006.01)
*G03G 15/09* (2006.01)

(52) U.S. Cl.
CPC ..... *G03G 15/0891* (2013.01); *G03G 15/09* (2013.01)

(58) Field of Classification Search
CPC ..... G03G 15/0891; G03G 15/09
See application file for complete search history.

(56) References Cited

U.S. PATENT DOCUMENTS 4,205,911 A * 6/1980 Dole ..... G03G 21/0035 15/256.52
2004/0028426 A1* 2/2004 Sugihara ..... G03G 15/09 399/254
2014/0270838 A1* 9/2014 Yoshizawa ..... G03G 15/0893 399/99

FOREIGN PATENT DOCUMENTS

JP 9-80906 3/1997
JP 2007-72329 3/2007

* cited by examiner

*Primary Examiner* — Clayton E Laballe
*Assistant Examiner* — Jas Sanghera
(74) *Attorney, Agent, or Firm* — Gerald E. Hespos; Michael J. Porco; Matthew T. Hespos

(57) ABSTRACT

A developing device includes a housing, a developing roller, a developer conveying section, and a conveying screw. The developing roller includes a stationary magnet, and a sleeve rotatable around the stationary magnet. The developing roller faces a photoconductive drum. The developer conveying section is disposed below the developing roller for circularly conveying developer therein. The conveying screw conveys developer to supply developer to the developing roller. The stationary magnet includes a separation pole for producing a magnetic field that causes separation of developer from the sleeve. The housing includes a standing wall disposed downstream of the developing position in a rotational direction of the sleeve and facing the developing roller. The standing wall is formed with at least one opening that faces the separation pole in a horizontal direction. The developing device further includes at least one filter section covering the at least one opening.

16 Claims, 10 Drawing Sheets

DEVELOPING DEVICE AND IMAGE FORMING APPARATUS INCLUDING THE SAME

INCORPORATION BY REFERENCE

This application is based on Japanese Patent Application No. 2016-102328 filed with the Japan Patent Office on May 23, 2016, the contents of which are hereby incorporated by reference.

BACKGROUND

The present disclosure relates to a developing device and an image forming apparatus including the same.

Conventional image forming apparatuses employing an electrophotographic method, such as a printer and a copier, include a photoconductive drum for carrying an electrostatic latent image, a developing device for supplying toner to the photoconductive drum to develop the electrostatic latent image into a toner image, and a transfer device for transferring the toner image from the photoconductive drum onto a sheet. The developing device includes a developing roller for supplying toner to the photoconductive drum.

There is known a developing device in which a casing rotatably supporting a developing roller includes a side seal for preventing leakage of developer. The side seal is formed with an opening communicating with an inside of the casing. Toner that has accumulated around the side seal flows into the casing through the opening. Consequently, toner scattering occurring around the developing roller is prevented.

Further, there is known a technique of setting, in a developing device, a driving torque for an entire developing unit and a driving torque for a conveying screw disposed in the unit in such a way as to satisfy a predetermined relational expression. The regulation of the driving torque for the conveying screw within a predetermined range prevents supplied toner from directly reaching the developing roller in a low charged or non-charged state, and in turn, prevents toner scattering.

SUMMARY

A developing device according to an aspect of the present disclosure includes a housing, a developing roller, a developer conveying section, and a conveying screw. The developing roller includes a stationary magnet, and a sleeve rotatable around the stationary magnet in a predetermined rotational direction and having a circumferential surface for carrying thereon developer containing toner and magnetic carrier, the stationary magnet having a plurality of magnetic poles arranged in a circumferential direction of the sleeve. The developing roller is disposed at a predetermined developing position at which the developing roller faces a photoconductive drum having a surface for allowing an electrostatic latent image to be formed thereon, to supply toner to the photoconductive drum. The developer conveying section is disposed below the developing roller in the housing for circularly conveying developer therein. The conveying screw is disposed in the developer conveying section and faces the developing roller at a predetermined facing position. The conveying screw is rotatable to convey developer in an axial direction of the developing roller to supply developer to the developing roller. The stationary magnet includes a separation pole for producing a magnetic field that causes separation of developer from the sleeve. The housing includes a standing wall disposed downstream of the developing position in a rotational direction of the sleeve and facing the developing roller. The standing wall is formed with at least one opening that faces the separation pole in a horizontal direction. The developing device further includes at least one filter section disposed on one side surface of the standing wall that is opposite to the other side surface facing the developing roller, the at least one filter section covering the at least one opening.

An image forming apparatus according to another aspect of the present disclosure includes the above-described developing device, the above-mentioned photoconductive drum for receiving toner supplied from the developing device and having the surface for carrying a toner image thereon, and a transfer section for transferring the toner image from the photoconductive drum onto a sheet.

These and other objects, features and advantages of the present disclosure will become more apparent upon reading the following detailed description along with the accompanying drawings.

DETAILED DESCRIPTION

Hereinafter, an image forming apparatus 10 according to an embodiment of the present disclosure will be described in detail with reference to the accompanying drawings. In the present embodiment, a tandem color printer is described as an example of the image forming apparatus. The image forming apparatus may alternatively be provided as a copier, a facsimile apparatus or a multifunctional apparatus equipped with these functions, for example.

Figure 1:
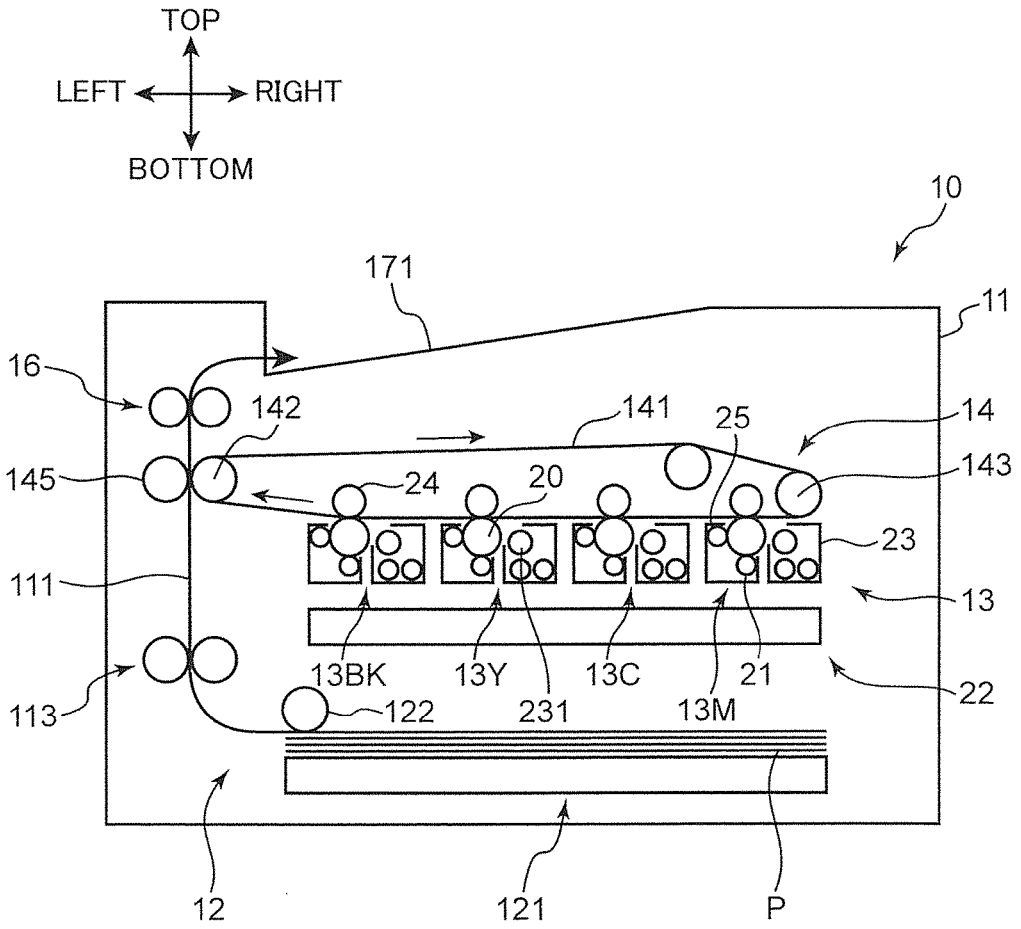
FIG. 1 is a sectional view showing an internal structure of an image forming apparatus according to an embodiment of the present disclosure.

FIG. 1 is a sectional view showing an internal structure of the image forming apparatus 10. The image forming apparatus 10 includes an apparatus body 11 in the form of a box-shaped housing. The apparatus body 11 includes therein a sheet feeding section 12 for feeding a sheet P, an image forming section 13 for forming a toner image to be transferred onto the sheet P fed by the sheet feeding section 12, an intermediate transfer unit 14 for allowing the toner image to be primarily transferred thereto, a secondary transfer roller 145, and a fixing section 16 for fixing the toner image to the sheet P, the toner image having been formed but not yet fixed on the sheet P. In addition, in an upper portion of the apparatus body 11, there is disposed a sheet receiving section 171 for receiving the sheet P discharged after having been subjected to the fixing process in the fixing section 16.

Further in the apparatus body 11, a sheet conveyance passage 111 extending in a vertical direction is formed on the left of the image forming section 13. A pair of conveyance rollers for conveying the sheet P is disposed at an appropriate position in the sheet conveyance passage 111. In addition, a pair of registration rollers 113 for performing skew correction of the sheet P and advancing the sheet P into a secondary transfer nip described later at a predetermined timing is disposed upstream of the nip in the sheet conveyance passage 111. The sheet conveyance passage 111 allows conveyance of the sheet P from the sheet feeding section 12 to the sheet receiving section 171 via the image forming section 13 (secondary transfer nip) and the fixing section 16.

The sheet feeding section 12 includes a sheet feeding tray 121 and a pick-up roller 122. The sheet feeding tray 121 is detachably mounted at a lower position of the apparatus body 11 and stores a sheet stack composed of a plurality of laminated sheets P. The pick-up roller 122 picks up the sheets P stored in the sheet feeding tray 121 one by one from the top of the sheet stack.

The image forming section 13 includes a plurality of image forming units which respectively form toner images of different colors that are to be transferred onto a sheet P. In the present embodiment, the image forming units include a magenta unit 13M which uses developer containing magenta (M) toner, a cyan unit 13C which uses developer containing cyan (C) toner, a yellow unit 13Y which uses developer containing yellow (Y) toner, and a black unit 13Bk which uses developer containing black (Bk) toner, the units 13M, 13C, 13Y and 13Bk being successively arranged from the upstream side to the downstream side in a rotational direction of an intermediate transfer belt 141 described later (from the right side to the left side of the sheet of FIG. 1). Each of the units 13M, 13C, 13Y and 13Bk includes a photoconductive drum 20, a charging device 21 disposed near the photoconductive drum 20, a developing device 23, and a cleaning device 25. Further, an exposure device 22 commonly used for the image forming units 13M, 13C, 13Y and 13Bk is disposed below these units.

The photoconductive drum 20 is driven to rotate about an axis thereof, and has a circumferential surface for allowing an electrostatic latent image and a toner image to be formed thereon. The photoconductive drums 20 are disposed at positions respectively corresponding to the image forming units for the different colors. The charging device 21 charges the surface of the photoconductive drum 20 uniformly. The exposure device 22 includes various optical system devices such as a light source, a polygon mirror, a reflection mirror and a deflection mirror, and irradiates the circumferential surface of the uniformly charged photoconductive drum 20 with beams of light having been modulated in accordance with image data to form an electrostatic latent image thereon. The cleaning device 25 cleans the circumferential surface of the photoconductive drum 20 after a toner image is transferred therefrom.

The developing device 23 supplies toner to the circumferential surface of the photoconductive drum 20 to develop an electrostatic latent image formed on the photoconductive drum 20. The developing device 23 is designed to use two-component developer composed of toner and carrier. In addition, in the present embodiment, toner has the property to be charged to a positive polarity.

The intermediate transfer unit 14 (transfer section) is disposed above the image forming section 13. The intermediate transfer unit 14 includes the intermediate transfer belt 141, a driving roller 142, a driven roller 143, and primary transfer rollers 24.

The intermediate transfer belt 141 is a rotary member in the form of an endless belt, and is wound around the driving roller 142 and the driven roller 143 so that a circumferential surface of the intermediate transfer belt 141 comes into contact with the circumferential surface of each photoconductive drum 20. The intermediate transfer belt 141 is driven to circularly move in a specific direction, and has a surface for carrying thereon toner images transferred from the photoconductive drums 20.

The driving roller 142 is disposed at a left end of the intermediate transfer unit 14 and supports the intermediate transfer belt 141 thereon in a strained state, the driving roller 142 being operable to drive the intermediate transfer belt 141 to circularly move. The driving roller 142 is made of a metallic material. The driven roller 143 is disposed at a right end of the intermediate transfer unit 14 and supports the intermediate transfer belt 141 thereon in the strained state, the driven roller 143 being operable to apply a tensile force to the intermediate transfer belt 141.

Each of the primary transfer rollers 24 defines a primary transfer nip in cooperation with the corresponding photoconductive drum 20 while sandwiching the intermediate transfer belt 141 therebetween, and primarily transfers a toner image formed on the photoconductive drum 20 onto the intermediate transfer belt 141. The primary transfer rollers 24 are disposed at positions respectively corresponding to the photoconductive drums 20 for the respective colors.

The secondary transfer roller 145 (transfer section) faces the driving roller 142 while sandwiching the intermediate transfer belt 141 therebetween. The secondary transfer roller 145 is pressed against the circumferential surface of the intermediate transfer belt 141, thereby defining the secondary transfer nip. A toner image primarily transferred on the intermediate transfer belt 141 is secondarily transferred onto a sheet P at the secondary transfer nip, the sheet P being supplied from the sheet feeding section 12. The intermediate transfer unit 14 and the secondary transfer roller 145 of the present embodiment constitute a transfer section of the present disclosure. The transfer section transfers a toner image from each photoconductive drum 20 to a sheet P.

A sheet P having been supplied to the fixing section 16 passes through a fixing nip at which the sheet P is heated and pressed. Consequently, a toner image transferred onto the sheet P at the secondary transfer nip is fixed to the sheet P.

The sheet receiving section 171 is in the form of a recess formed in a top portion of the apparatus body 11. A sheet P having been subjected to the fixing process is discharged onto the sheet receiving section 171 by way of the sheet conveyance passage 111 extending from an upper portion of the fixing section 16.

Figure 2:
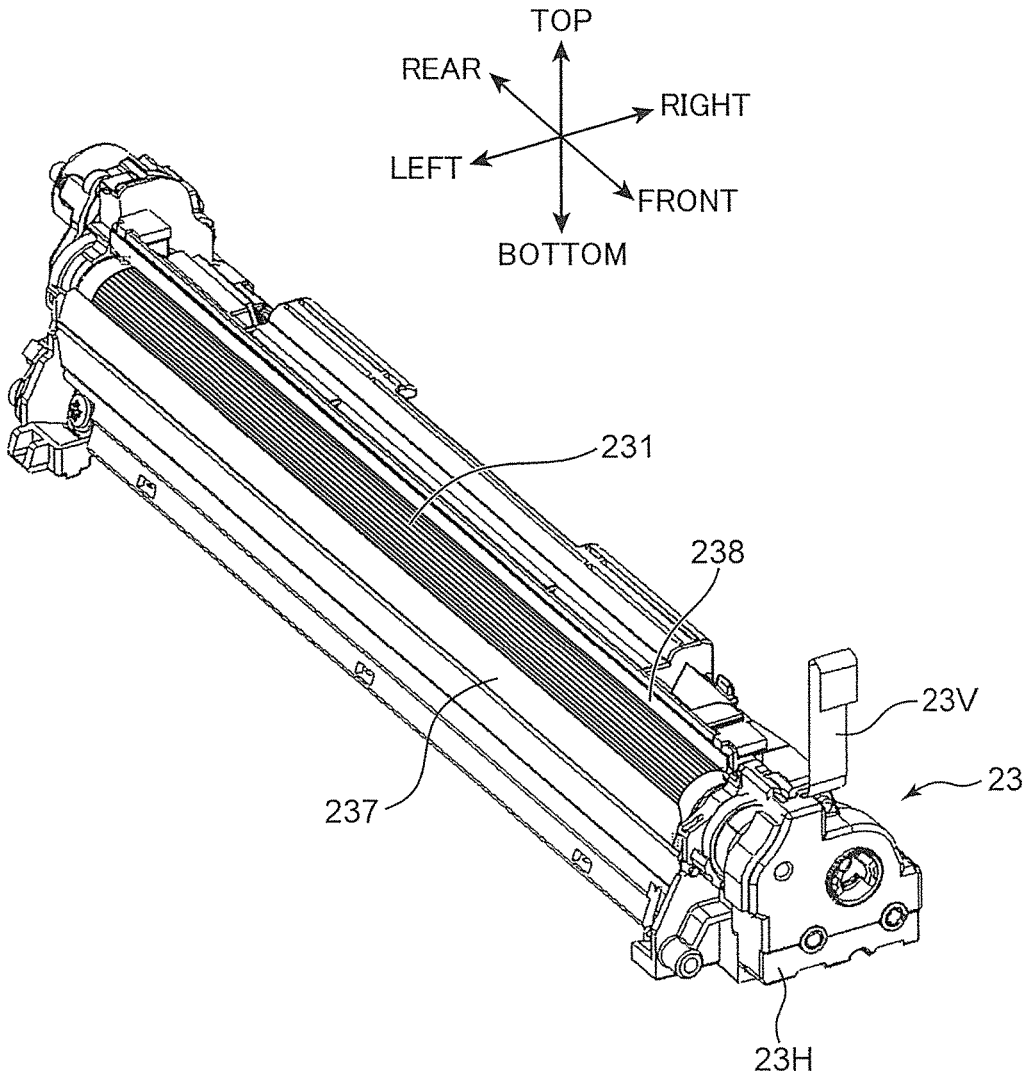
FIG. 2 is a perspective view of a developing device according to the embodiment of the present disclosure.
Figure 3:
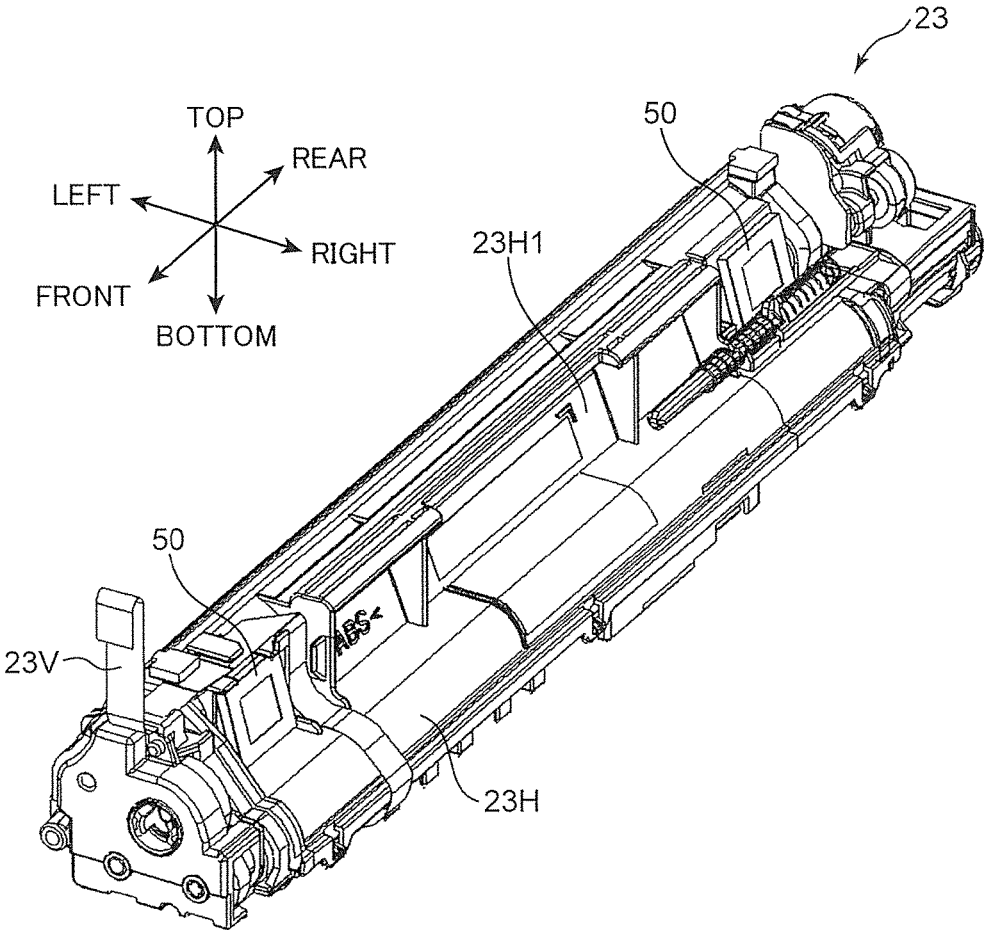
FIG. 3 is a perspective view of the developing device according to the embodiment of the present disclosure.
Figure 4:
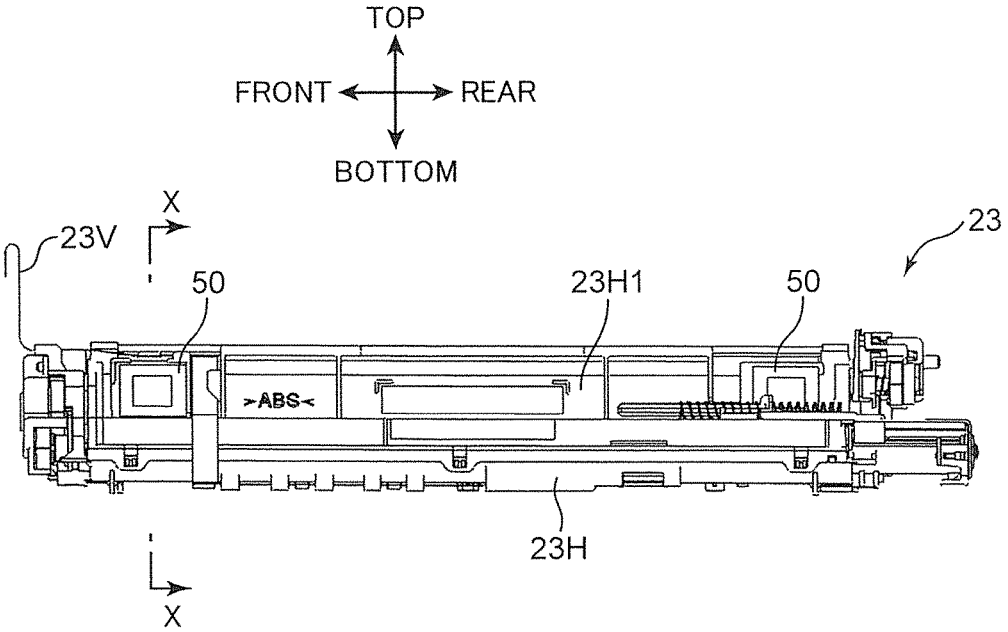
FIG. 4 is a side view of the developing device according to the embodiment of the present disclosure.
Figure 5A:
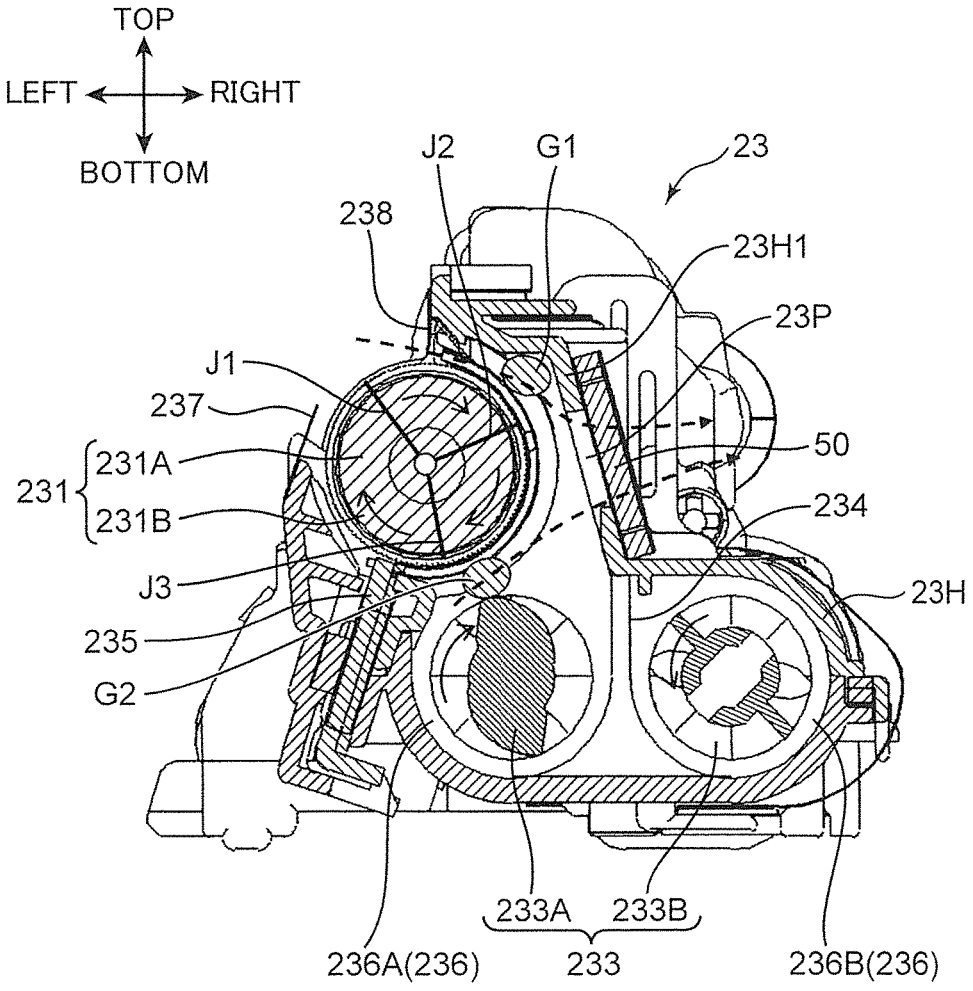
FIG. 5A is a sectional view of the developing device according to the embodiment of the present disclosure.
Figure 5B:
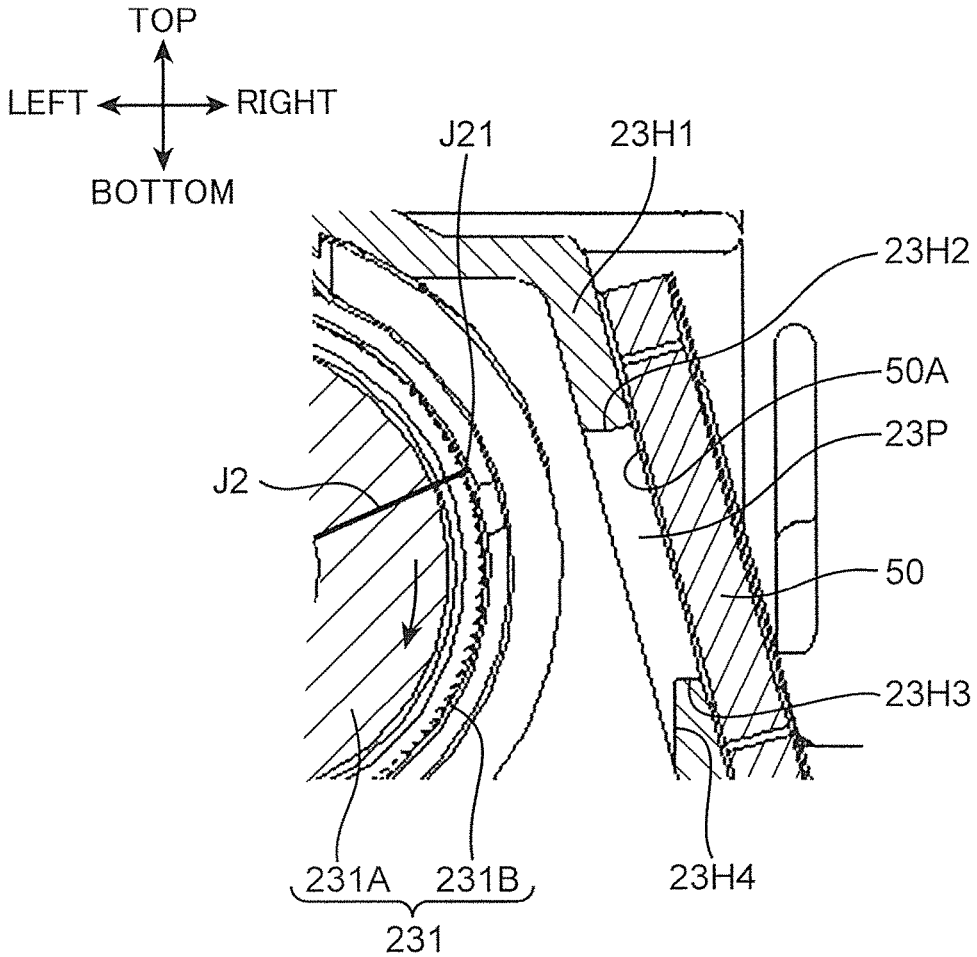
FIG. 5B is an enlarged sectional view of a part of the developing device shown in FIG. 5A.
Figure 6:
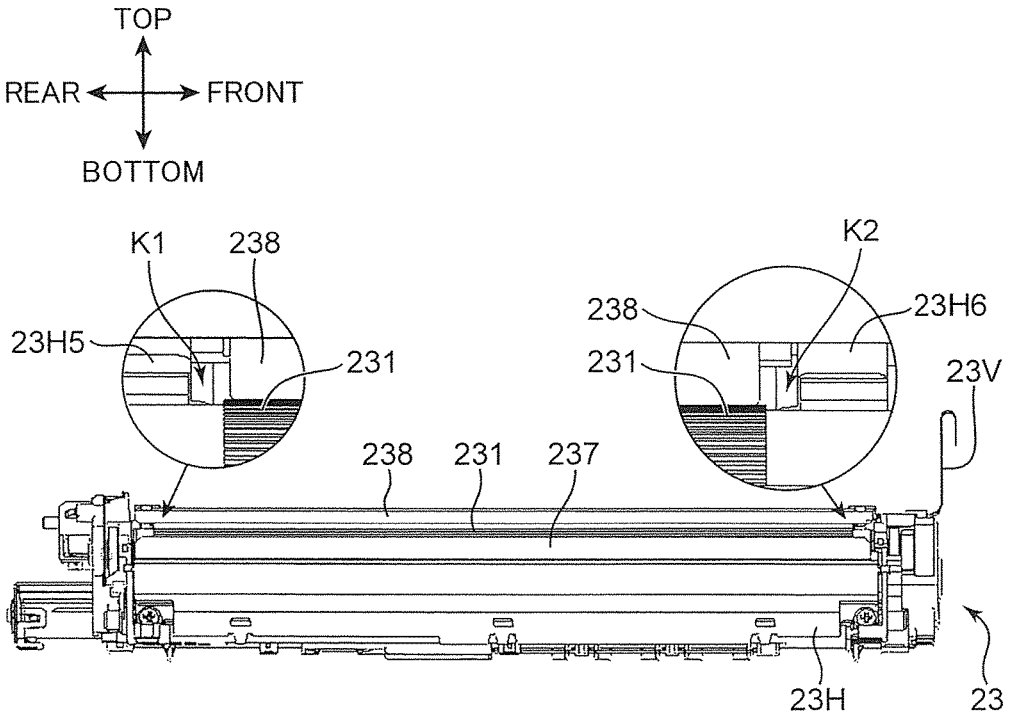
FIG. 6 is a side view of the developing device according to the embodiment of the present disclosure with a part thereof being shown in an enlarged scale.
Figure 7:
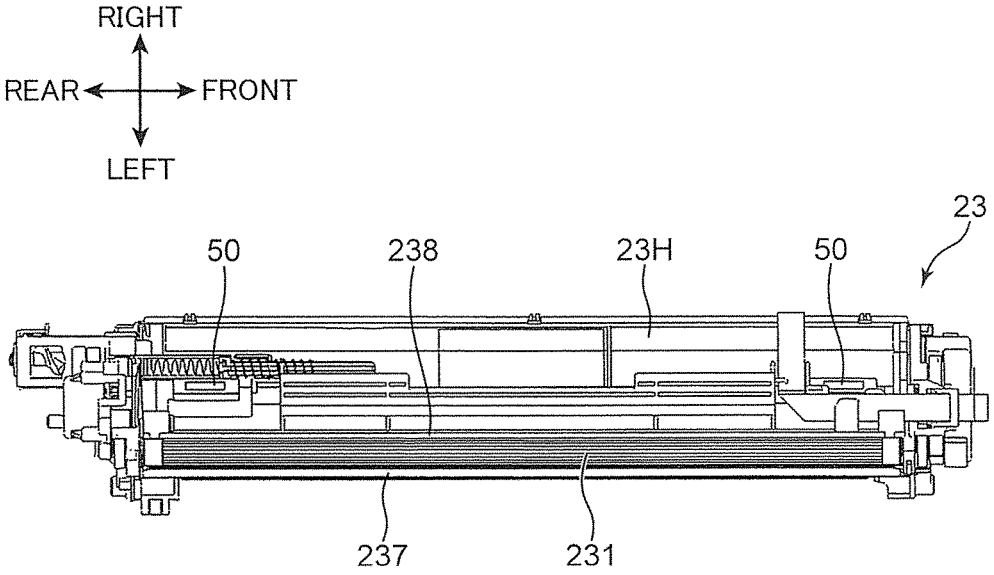
FIG. 7 is a plan view of the developing device according to the embodiment of the present disclosure.

Now, the developing device 23 according to the embodiment of the present disclosure will be further described in detail with reference to FIGS. 2 to 7. FIGS. 2 and 3 are perspective views of the developing device 23 according to the present embodiment. FIG. 4 is a side view of the developing device 23. FIG. 5A is a sectional view (taken along the section line X-X shown in FIG. 4) of the developing device 23 according to the present embodiment, and FIG. 5B is an enlarged sectional view of a part of the developing device 23 shown in FIG. 5A. FIG. 6 is a side view of the developing device 23 with a part thereof being shown in an enlarged scale. FIG. 7 is a plan view of the developing device 23.

The developing device 23 includes a development housing 23H (FIG. 3) (housing), a developing roller 231 (FIG. 2), a power supply member 23V, a pair of stirring screws 233 (FIG. 5A), a partition plate 234 (FIG. 5A), and a layer thickness regulating member 235 (FIG. 5A). The development housing 23H supports various components of the developing device 23.

As shown in FIG. 1, the developing roller 231 faces the photoconductive drum 20 having the surface for allowing an electrostatic latent image to be formed thereon at a predetermined developing position, to supply toner to the photoconductive drum 20. With reference to FIG. 5A, the developing roller 231 includes a stationary magnet 231A and a sleeve 231B. The stationary magnet 231A is in the form of a cylinder and supported on the development housing 23H, the stationary magnet 231A including a plurality of magnetic poles arranged in a circumferential direction. The sleeve 231B rotates around the stationary magnet 231A in a predetermined rotational direction (see arrows shown in FIG. 5A) and has a circumferential surface for carrying thereon developer containing toner and magnetic carrier. In the present embodiment, the sleeve 231B is in the form of an aluminum circular tube member (base material). The circular tube member of the sleeve 231B has a circumferential surface subjected to a sandblasting process (blasting process) and thereby having a predetermined surface roughness. In the present embodiment, the surface roughness Rzjis of the sleeve 231B is set in the range from 4.0 μm to 14.0 μm. The sleeve 231B of the developing roller 231 is rotatably supported on the development housing 23H.

A development bias is applied to the sleeve 231B of the developing roller 231, the development bias including a direct current bias and an alternating current bias that are superposed on each other. The power supply member 23V is in the form of a metal plate and secured to development housing 23H. One end of the power supply member 23V is electrically connected to a predetermined power source disposed in the image forming apparatus 10, and the other end of the power supply member 23V is electrically connected to the sleeve 231B. The above-mentioned development bias is applied via the power supply member 23V.

The stirring screw 233 circularly conveys two-component developer while stirring it to thereby charge the toner. The stirring screw 233 includes a first screw 233A (conveying screw) and a second screw 233B. Each of the first screw 233A and the second screw 233B includes a shaft and a helical blade formed around the shaft.

The development housing 23H includes a developer stirring section 236 (developer conveying section). The developer stirring section 236 is disposed in the development housing 23H and below the developing roller 231. Developer is circularly conveyed in the developer stirring section 236. The developer stirring section 236 includes a first stirring portion 236A and a second stirring portion 236B. The first stirring portion 236A and the second stirring portion 236B are each in the form of a conveyance passage extending in an axial direction of the developing roller 231. The first stirring portion 236A and the second stirring portion 236B are divided from each other by a partition plate 234. The above-mentioned first and second screws 233A and 233B are rotatably disposed in the first and second stirring portions 236A and 236B, respectively. The first and second screws 233A and 233B are rotated in respective directions of arrows shown in FIG. 5A. Consequently, developer is conveyed in the first stirring portion 236A and in the second stirring portion 236B in opposite directions.

As shown in FIG. 5A, the first screw 233A is disposed in the developer stirring section 236 and faces the developing roller 231 at a predetermined facing position (G2 in FIG. 5A). The first screw 233A is rotated to convey developer in the axial direction of the developing roller 231 and supply developer to the developing roller 231. In particular, the first screw 233A is rotated in such a way as to move in a direction opposite to a movement of the sleeve 231B of the developing roller 231 at the facing position. Further, as shown in FIG. 5A, an axis of the first screw 233A lies below an axis of the developing roller 231.

The layer thickness regulating member 235 has a plate-like shape and is made of a non-magnetic metal, the layer thickness regulating member 235 being disposed opposite the circumferential surface of the sleeve 231B of the developing roller 231. The layer thickness regulating member 235 is supported on the development housing 23H. In another embodiment, a magnetic member may be secured to a side surface of the layer thickness regulating member 235 that lies upstream in the rotational direction of the sleeve 231B. The layer thickness regulating member 235 regulates the layer thickness of developer supplied to the developing roller 231 from the first screw 233A shown in FIG. 5A.

Further, with reference to FIG. 5A, developer containing toner and carrier and having been circularly conveyed by the pair of stirring screws 233 is supplied from the first screw 233A to the developing roller 231. Thereafter, the developer is supplied to the developing position after the layer thickness thereof is regulated by the layer thickness regulating member 235. When a portion of the toner is supplied to the photoconductive drum 20 at the developing position, the remaining developer is separated from the developing roller 231. Thereafter, the separated developer flows back into the first stirring portion 236A.

With reference to FIG. 5A, in the present embodiment, the stationary magnet 231A of the developing roller 231 includes the plurality of magnetic poles arranged in the circumferential direction. In particular, the stationary magnet 231A includes a main pole J1, a separation pole J2 (separation pole), and a draw-up pole J3. FIG. 5A shows straight lines that connect the rotational axis of the developing roller 231 with a peak (maximum value) position of the radial component of magnetic flux density of each magnetic pole. The main pole J1 lies opposite the developing position (photoconductive drum 20). The separation pole J2 lies downstream of the main pole J1 in the rotational direction of the sleeve 231B, and has a function of producing a magnetic field that causes separation (removal) of developer from the sleeve 231B. The draw-up pole J3 has a function of attracting and drawing up developer supplied from the first screw 233A to the sleeve 231B. The separation pole J2 and the draw-up pole J3 are desired to have the same polarity. In addition, an unillustrated magnetic pole for conveyance is disposed between the draw-up pole J3 and the main pole J1 and between the main pole J1 and the separation pole J2.

With reference to FIG. 5A, the development housing 23H includes a standing wall 23H1. The standing wall 23H1 constitutes a portion of the development housing 23H, the standing wall 23H1 being disposed downstream of the develop position in the rotational direction of the sleeve 231B and facing the developing roller 231. The standing wall 23H1 extends in the axial direction (longitudinal direction) of the developing roller 231. Further, the standing wall 23H1 slightly slopes upward from right to left (toward the developing roller 231) as shown in FIG. 5A. A lower end of the standing wall 23H1 is connected to an upper end of the partition plate 234. Consequently, the standing wall 23H1 defines an upper portion of the first stirring portion 236A. With reference to FIG. 5A, the sleeve 231B of the developing roller 231 rotates downward from an upper position in a zone facing the standing wall 23H1.

The standing wall 23H1 is formed with a pair of openings 23P (FIG. 5A). Each opening 23P has a rectangular shape and allows communication between the upper portion of the first stirring portion 236A and an outside of the development housing 23H. The pair of openings 23P are formed at positions corresponding to axial opposite ends of the developing roller 231 (see the positions of filter sections 50 shown in FIGS. 3 and 4). Further, as shown in FIG. 5A, the openings 23P face the separation pole J2 of the stationary magnet 231A of the developing roller 231 in a horizontal direction.

With reference to FIGS. 5A and 5B, in a sectional view perpendicularly intersecting the axis of the developing roller 231, a reference point J21 (FIG. 5B) lies below respective opening upper ends 23H2 (upper end) of the openings 23P in a vertical direction, the reference point J21 being a point at which a straight line connecting a peak position of the separation pole J2 in a circumferential distribution of radial component of magnetic flux density of the stationary magnet 231A with the axis of the developing roller 231 crosses the surface of the sleeve 231. Further, respective opening lower ends 23H3 (lower end) of the openings 23P lie above the highest position of a blade tip edge of the first screw 233A.

Figure 8:
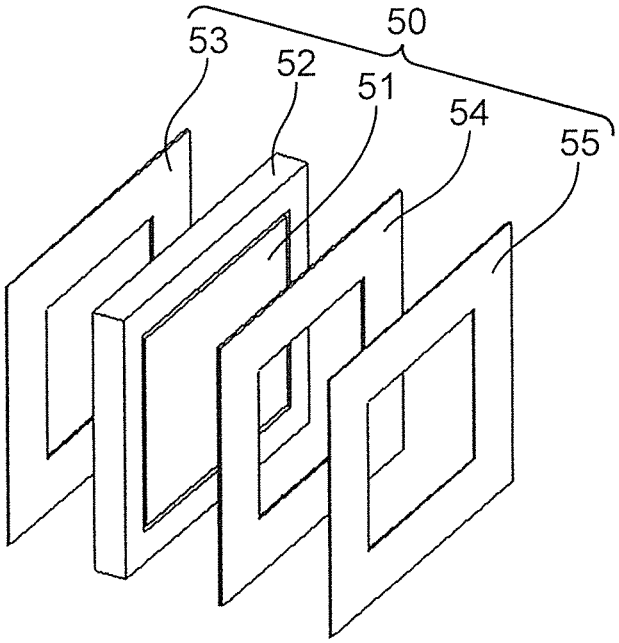
FIG. 8 is an exploded perspective view of a filter section of the developing device according to the embodiment of the present disclosure.
Figure 9:
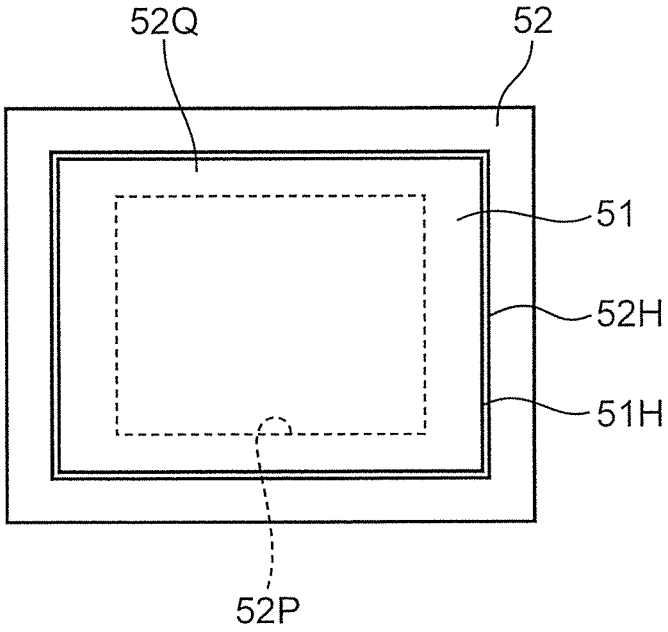
FIG. 9 is a front view of a non-woven filter and a frame of the developing device according to the embodiment of the present disclosure.

Further, the developing device 23 includes the filter sections 50. FIG. 8 is an exploded perspective view of the filter section 50 of the developing device 23 according to the present embodiment. FIG. 9 is a front view of a non-woven filter 51 and a frame 52 of the filter section 50.

With reference to FIGS. 3, 4 and 5A, the filter sections 50 are disposed on one side surface of the standing wall 23H1 that is opposite to the other side surface facing the developing roller 231, and cover the openings 23P. The filter sections 50 have a function of allowing air to flow from the inside to the outside or vice versa of the development housing 23H through the openings 23P, and preventing leakage of toner out of the development housing 23H.

With reference to FIG. 8, each filter section 50 includes a non-woven filter 51, a frame 52, an inner double-sided tape 53, an outer double-sided tape 54 (pushing member), and a PET film 55 (pushing member).

The non-woven filters 51 respectively face the openings 23P and serve to collect toner and allow air to flow from the inside to the outside or vice versa of the development housing 23H. The non-woven filters 51 each have a rectangular shape greater than the openings 23P. The non-woven filter 51 is in the form of laminated non-woven fibers in which many spaces for allowing flow of air therethrough are defined. Therefore, even when a large amount of toner is collected on a sealing surface 50A (FIG. 5B) of the non-woven filter 51 that covers the opening 23P, the flow paths for air are sufficiently secured. As a result, the pressure loss of the air flowing through the opening 23P can be reduced. It is preferred to use, for the non-woven fibers of the non-woven filter 51, fibers capable of being charged positively and negatively to have an electric charge. In this case, it is possible to enhance the toner collecting effect of the non-woven filter 51. In the present embodiment, an EFR-65NH (erythron) manufactured by TOYOBO CO., LTD. is used for the non-woven filter 51.

The frame 52 has a function of supporting the non-woven filter 51. In the present embodiment, the frame 52 is made of a resiliently compressible sponge material. In another embodiment, the frame 52 may be made of another material such as a resin. With reference to FIG. 9, the frame 52 includes a supporting wall 52Q having a rectangular shape greater than the non-woven filter 51, and has a predetermined dimension in a direction of passage of air. The frame 52 is formed with a frame opening 52P for exposing the non-woven filter 51 to the opening 23P. When the filter section 50 is mounted to the development housing 23H, the frame opening 52P lies at a position corresponding to the opening 23P. In the present embodiment, the non-woven filter 51 in the form of a soft and thin sheet is supported by the frame 52, and the frame 52 is mounted to the development housing 23H. Therefore, it is possible to discharge air flowing in the development housing 23H to the outside of the development housing 23H, and to prevent developer existing in the development housing 23H from leaking to the outside owing to the non-woven filter 51.

An outer portion of the frame 52 that faces the outer double-sided tape 54 (FIG. 8) has a recessed surface except for its peripheral portion. The bottom of the recess is defined by the supporting wall 52Q (FIG. 9) to which the non-woven filter 51 is attached. Consequently, the non-woven filter 51 is supported on the frame 52. In addition, as shown in FIG. 9, the supporting wall 52Q has the frame opening 52P therein. A peripheral wall 52H extends from a peripheral edge of the supporting wall 52Q, thereby defining the recess. The peripheral wall 52H has the predetermined dimension in the direction of passage of air flowing through the non-woven filter 51. The peripheral wall 52H faces an outer peripheral edge of the non-woven filter 51. More specifically, in the present embodiment, when the non-woven filter 51 is fitted in the recess of the frame 52, the outer peripheral edge (four side edges) of the non-woven filter 51 comes into contact with the peripheral wall 52H of the frame 52. In a manufacturing process of the non-woven filter 51 having a rectangular shape, a large non-woven fabric is cut into non-woven filters 51 successively. In this case, fibers at the outer peripheral edge of the non-woven filter 51 are liable to fray and come off. In the present embodiment, the outer peripheral edge and end surfaces of the non-woven filter 51 are covered by the frame 52 as mentioned above. In particular, the peripheral wall 52H of the frame 52 faces and is in contact with the outer peripheral edge of the non-woven filter 51, which further prevents the fraying of fibers. Consequently, it is possible to prevent a fiber fragment of the non-woven filter 51 from flowing into or out of the development housing 23H. In particular, it is possible to prevent a non-woven fabric fragment from getting into the development housing 23H to adhere to the developing roller 231 and consequently appear on a toner image as an imaging failure.

The inner double-sided tape 53 bonds an inner surface of the frame 52 to the standing wall 23H1 of the development housing 23H. On the other hand, the outer double-sided tape 54 is attached to the supporting wall 52Q defining the recess of the frame 52, thereby bonding the frame 52 and the PET film 55 together. In this case, the outer double-sided tape 54 and the PET film 55 are secured to the frame 52 while sandwiching the non-woven filter 51 with the supporting wall 52Q of the frame 52. Consequently, an outer peripheral portion of the non-woven filter 51 is sandwiched between the frame 52, and the outer double-sided tape 54 and PET film 55, so that the above-mentioned fraying of fibers can be further prevented. Therefore, it is possible to further prevent a non-woven fabric fragment from getting into or out of the development housing 23H.

With reference to FIG. 5A, an electrostatic latent image formed on the photoconductive drum 20 (FIG. 1) is developed into a toner image by the developing roller 231 in accordance with an image forming operation performed by the image forming apparatus 10. When the developing roller 231 is rotated in the direction of the arrows shown in FIG. 5A, air is drawn into the development housing 23H (see the dashed arrows passing through a zone G1 in FIG. 5A). When the drawn air collides against the standing wall 23H1, high pressure air is likely to be produced in the zone G1. Such high pressure air tends to flow out of the development housing 23H. In particular, as shown in the enlarged views of FIG. 6, spaces K1 and K2 are respectively defined between one of opposite ends of an upper seal 238 covering an upper portion of the developing roller 231 and a housing rear wall portion 23H5 and between the other of the opposite ends of the upper seal 238 and a housing front wall portion 23H6, the spaces K1 and K2 allowing the air to flow out therethrough. When the air flows out of the development housing 23H through the spaces K1 and K2, toner particles floating in the development housing 23H scatter to the outside. This results in an imaging failure.

On the other hand, in the present embodiment, the opening 23P and the filter section 50 are disposed at each of the opposite ends of the developing roller 231 (see FIG. 7). In this manner, the openings 23P are formed at positions opposite the regions where the sealing between the developing roller 231 and the development housing 23H is liable to deteriorate. This makes it possible to prevent a pressure rise in the development housing 23H and, in turn, scattering of toner.

Further, in the present embodiment, as shown in FIGS. 5A and 5B, the openings 23P formed in the standing wall 23H1 face the separation pole J2 of the developing device 23 in the horizontal direction. Therefore, it is possible to discharge air existing in the development housing 23H to the outside at the positions near the region where developer is separated from the sleeve 231B by the magnetic field of the separation pole J2 upon rotation of the developing roller 231. Consequently, an air flow generated by the rotation of the developing roller 231 and the separation of developer is promptly discharged to the outside of the development housing 23H. Therefore, as compared with a case where the openings 23P are formed at other positions, a pressure rise in the development housing 23H during the rotation of the developing roller 231 can be prevented. Consequently, it is possible to prevent toner scattering caused by a pressure rise in the development housing 23H.

Further, the above-mentioned reference point J21 (FIG. 5B) lies below the respective upper ends of the openings 23P in the vertical direction. In this manner, the openings 23P lie on a downstream side of the air flow generated in the separation of developer. This can further prevent a pressure rise in the development housing 23H. Further, the respective opening lower ends 23H3 of the openings 23P lie above the highest position of the blade tip edge of the first screw 233A. This makes it possible to eliminate, by the openings 23P formed above the first screw 233A, the non-uniformity of pressure distribution in the development housing 23H caused by the rotation of the first screw 233A (see the dashed arrows passing through the zone G2 in FIG. 5A).

In addition, in the present embodiment, the developing roller 231 and the first screw 233A are rotated in such a manner as to move in the opposite directions at their mutually facing position (FIG. 5A) as mentioned above. Even when portions of developer collide with each other at the facing position owing to the rotations of the developing roller 231 and the first screw 233A and consequently a strong flow of air is generated in the development housing 23H, the internal pressure of the development housing 23H can be reduced by the openings 23P.

Further, with reference to FIG. 5B, in the present embodiment, in the standing wall 23H1 defining the openings 23P, the thickness of the opening upper end 23H2 is smaller than the thickness of the opening lower end 23H3. In other words, the opening lower end 23H3 includes a cutout 23H4 obtained by cutting out one end edge of the opening lower end 23H3 that is opposite to the other end edge being in contact with the sealing surface 50A. Consequently, developer is unlikely to accumulate at the opening lower end 23H3. Therefore, it is possible to prevent fraying of a non-woven fabric fragment of the sealing surface 50A caused by a movement of developer over the opening lower end 23H3. Further, the filter section 50 is disposed on the outer side of the opening 23P, which allows the sealing surface 50A to lie at a distance from the separation pole J2 of the developing roller 231, the distance corresponding to the thickness of the standing wall 23H1. Consequently, it is possible to prevent developer having been separated from the sleeve 231B by the separation pole J2 from colliding against the sealing surface 50A. Therefore, the fraying of a non-woven fabric fragment can be further prevented.

Further, as shown in FIG. 5A, in the present embodiment, the openings 23P are formed in the standing wall 23H1, and the developer stirring section 236 for circularly conveying developer lies below the standing wall 23H1. Therefore, it is possible to prevent developer being conveyed in the developer stirring section 236 from adhering to the sealing surfaces 50A of the filter sections 50. Further, the first screw 233A rotates in such a manner that one half of the rotation where the blade tip edge moves downward from an upper position is performed in a region below and close to the standing wall 23H1. In other words, the other half of the rotation where the blade tip edge of the first screw 233A moves upward from a lower position is performed in a region at a leftward distance from the standing wall 23H1. As a result, even if developer is blown upward by rotation of the first screw 233A, the developer will be prevented from reaching the sealing surfaces 50A. Consequently, fraying of a non-woven fabric fragment at the sealing surfaces 50A is further prevented. In addition, as mentioned above, the sleeve 231B of the developing roller 231 and the first screw 233A rotate in such a manner as to move in the opposite directions in the zone G2 (FIG. 5A). This makes it possible to further prevent the blown-up developer from scattering toward the openings 23P.

Further, because the openings 23P are formed in the standing wall 23H1 lying above the developer stirring section 236 as mentioned above, even when the developing device 23 is in a maintenance state (a state of the developing device 23 having been dismounted from the image forming apparatus 10 for maintenance) as shown in FIG. 3 and the filter section 50 is detached by a worker, leakage of developer through the opening 23P is prevented.

Further, in the present embodiment, as shown in FIG. 5A, the axis of the first screw 233A lies at a position below the developing roller 231 and shifted rightward of the axis of the developing roller 231. In other words, the axis of the first screw 233A lies at a position shifted from a position directly under the axis of the developing roller 231 in a direction away from the photoconductive drum 20. The filter sections 50 are mounted to the standing wall 23H1, and extend substantially in parallel to a straight line connecting the axis of the developing roller 231 with the axis of the first screw 233A. This allows the filter sections 50 to reliably collect toner scattered from the zone G1 and the zone G2 shown in FIG. 5A (see the dashed arrows shown in FIG. 5A).

Further, in the present embodiment, the lower end of the standing wall 23H1 is connected to the upper end of the partition wall 234. Further, the partition wall 234 has a function of preventing toner scattered from the second stirring portion 236B from reaching the filter section 50. Therefore, it is possible to prevent clogging of the filter section 50 and thereby extend the life of the filter section 50.

The developing device 23 and the image forming apparatus 10 including the developing device 23 according to the embodiment of the present disclosure have been described in detail. The present disclosure, however, is not limited to the described configurations and, for example, the following modified embodiments may be adopted.

(1) In the above-described embodiment, the developing device 23 includes the developing roller 231 as a roller for carrying developer. However, the present disclosure is not limited to this configuration. The developing device 23 may be configured to include a plurality of rollers so that developer is delivered by the plurality of rollers.

(2) In the above-described embodiment, the developing roller 231 is applied with a development bias including direct current and alternating current biases. Alternatively, a development bias including only a direct current bias may be applied.

(3) Further, in the above-described embodiment, the filter section 50 includes the non-woven filter 51. However, the present disclosure is not limited to this configuration. The filter section 50 may alternatively be configured to include a filter made of a material other than the non-woven fabric.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. A developing device, comprising:

a housing;

a developing roller including a stationary magnet, and a sleeve rotatable around the stationary magnet in a predetermined rotational direction and having a circumferential surface for carrying thereon developer containing toner and magnetic carrier, the stationary magnet having a plurality of magnetic poles arranged in a circumferential direction of the sleeve, and the developing roller being disposed at a predetermined developing position at which the developing roller faces a photoconductive drum having a surface for allowing an electrostatic latent image to be formed thereon, to supply toner to the photoconductive drum;

a developer conveying section disposed below the developing roller in the housing for circularly conveying developer; and a conveying screw disposed in the developer conveying section and facing the developing roller at a predetermined facing position, the conveying screw being rotatable to convey developer in an axial direction of the developing roller to supply developer to the developing roller, wherein:

the stationary magnet includes a separation pole for producing a magnetic field that causes separation of developer from the sleeve;

the housing includes a standing wall disposed downstream of the developing position in a rotational direction of the sleeve and facing the developing roller, the standing wall being formed with at least one opening that faces the separation pole in a horizontal direction, the developing device further comprising at least one filter section disposed on one side surface of the standing wall that is opposite to the other side surface facing the developing roller, the at least one filter section covering the at least one opening, in a sectional view perpendicularly intersecting an axis of the developing roller, a reference point lies below an upper end of the opening in a vertical direction, the reference point being a point at which a straight line connecting a peak position of the separation pole in a circumferential distribution of radial component of magnetic flux density of the stationary magnet with the axis of the developing roller crosses the surface of the sleeve; and a lower end of the opening lies above a highest position of a blade tip edge of the conveying screw.

2. The developing device according to claim 1, wherein:

the filter section includes a non-woven filter facing the opening, and a frame supporting the non-woven filter.

3. The developing device according to claim 2, wherein the frame includes a supporting wall supporting the non-woven filter thereon, the supporting wall being formed with a frame opening that lies at a position corresponding to the opening, and a peripheral wall extending from a peripheral edge of the supporting wall and facing an outer peripheral edge of the non-woven filter supported on the supporting wall the peripheral wall of the frame is in contact with the outer peripheral edge of the non-woven filter.

4. The developing device according to claim 2, wherein the frame includes a supporting wall supporting the non-woven filter thereon, the supporting wall being formed with a frame opening that lies at a position corresponding to the opening, and a peripheral wall extending from a peripheral edge of the supporting wall and facing an outer peripheral edge of the non-woven filter supported on the supporting wall, and wherein the filter section further includes a holding member secured to the frame, the holding member sandwiching the non-woven filter with the supporting wall of the frame.

5. The developing device according to claim 1, wherein:

the sleeve of the developing roller rotates downward from an upper position in a zone facing the standing wall; and the conveying screw rotates in such a manner as to move in a direction opposite to a movement of the sleeve at the facing position.

6. An image forming apparatus, comprising:

the developing device according to claim 1;

the photoconductive drum for receiving toner supplied from the developing device and having a circumferential surface for carrying a toner image thereon; and a transfer section for transferring the toner image from the photoconductive drum onto a sheet.

7. A developing device, comprising:

a housing;

a developing roller including a stationary magnet, and a sleeve rotatable around the stationary magnet in a predetermined rotational direction and having a circumferential surface for carrying thereon developer containing toner and magnetic carrier, the stationary magnet having a plurality of magnetic poles arranged in a circumferential direction of the sleeve, and the developing roller being disposed at a predetermined developing position at which the developing roller faces a photoconductive drum having a surface for allowing an electrostatic latent image to be formed thereon, to supply toner to the photoconductive drum;

a developer conveying section disposed below the developing roller in the housing for circularly conveying developer; and a conveying screw disposed in the developer conveying section and facing the developing roller at a predetermined facing position, the conveying screw being rotatable to convey developer in an axial direction of the developing roller to supply developer to the developing roller, wherein:

the stationary magnet includes a separation pole for producing a magnetic field that causes separation of developer from the sleeve;

the housing includes a standing wall disposed downstream of the developing position in a rotational direction of the sleeve and facing the developing roller, the standing wall being formed with at least one opening that faces the separation pole in a horizontal direction, the developing device further comprising at least one filter section disposed on one side surface of the standing wall that is opposite to the other side surface facing the developing roller, the at least one filter section covering the at least one opening; and the at least one opening includes a pair of openings respectively facing axially opposite ends of the developing roller.

8. An image forming apparatus, comprising:

the developing device according to claim 7;

the photoconductive drum for receiving toner supplied from the developing device and having a circumferential surface for carrying a toner image thereon; and a transfer section for transferring the toner image from the photoconductive drum onto a sheet.

9. A developing device, comprising:

a housing;

a developing roller including a stationary magnet, and a sleeve rotatable around the stationary magnet in a predetermined rotational direction and having a circumferential surface for carrying thereon developer containing toner and magnetic carrier, the stationary magnet having a plurality of magnetic poles arranged in a circumferential direction of the sleeve, and the developing roller being disposed at a predetermined developing position at which the developing roller faces a photoconductive drum having a surface for allowing an electrostatic latent image to be formed thereon, to supply toner to the photoconductive drum;

a developer conveying section disposed below the developing roller in the housing for circularly conveying developer; and a conveying screw disposed in the developer conveying section and facing the developing roller at a predetermined facing position, the conveying screw being rotatable to convey developer in an axial direction of the developing roller to supply developer to the developing roller, wherein:

the stationary magnet includes a separation pole for producing a magnetic field that causes separation of developer from the sleeve; and the housing includes a standing wall disposed downstream of the developing position in a rotational direction of the sleeve and facing the developing roller, the standing wall being formed with at least one opening that faces the separation pole in a horizontal direction, the developing device further comprising at least one filter section disposed on one side surface of the standing wall that is opposite to the other side surface facing the developing roller, the at least one filter section covering the at least one opening the opening has a rectangular shape;

the filter section includes a non-woven filter that faces the opening and that has a rectangular shape greater than the opening; and a frame that supports the filter, the frame includes a supporting wall supporting the non-woven filter thereon, the supporting wall being formed with a frame opening that lies at a position corresponding to the opening, and a peripheral wall extending from a peripheral edge of the supporting wall and facing an outer peripheral edge of the non-woven filter supported on the supporting wall.

10. The developing device according to claim 9, wherein the peripheral wall of the frame is in contact with the outer peripheral edge of the non-woven filter.

11. The developing device according to claim 9, wherein the filter section further includes a holding member secured to the frame, the holding member sandwiching the non-woven filter with the supporting wall of the frame.

12. An image forming apparatus, comprising:

the developing device according to claim 9;

the photoconductive drum for receiving toner supplied from the developing device and having a circumferential surface for carrying a toner image thereon; and a transfer section for transferring the toner image from the photoconductive drum onto a sheet.

13. A developing device, comprising:

a housing;

a developing roller including a stationary magnet, and a sleeve rotatable around the stationary magnet in a predetermined rotational direction and having a circumferential surface for carrying thereon developer containing toner and magnetic carrier, the stationary magnet having a plurality of magnetic poles arranged in a circumferential direction of the sleeve, and the developing roller being disposed at a predetermined developing position at which the developing roller faces a photoconductive drum having a surface for allowing an electrostatic latent image to be formed thereon, to supply toner to the photoconductive drum;

a developer conveying section disposed below the developing roller in the housing for circularly conveying developer; and a conveying screw disposed in the developer conveying section and facing the developing roller at a predetermined facing position, the conveying screw being rotatable to convey developer in an axial direction of the developing roller to supply developer to the developing roller, wherein:

the stationary magnet includes a separation pole for producing a magnetic field that causes separation of developer from the sleeve;

the housing includes a standing wall disposed downstream of the developing position in a rotational direction of the sleeve and facing the developing roller, the standing wall being formed with at least one opening that faces the separation pole in a horizontal direction, the developing device further comprising at least one filter section disposed on one side surface of the standing wall that is opposite to the other side surface facing the developing roller, the at least one filter section covering the at least one opening;

in a sectional view perpendicularly intersecting an axis of the developing roller, an axis of the conveying screw lies at a position shifted from a position directly under the axis of the developing roller in a direction away from the photoconductive drum; and the filter section is mounted on the standing wall, and extends substantially in parallel to a straight line connecting the axis of the developing roller with the axis of the conveying screw.

14. An image forming apparatus, comprising:

the developing device according to claim 13;

the photoconductive drum for receiving toner supplied from the developing device and having a circumferential surface for carrying a toner image thereon; and a transfer section for transferring the toner image from the photoconductive drum onto a sheet.

15. A developing device, comprising:

a housing;

a developing roller including a stationary magnet, and a sleeve rotatable around the stationary magnet in a predetermined rotational direction and having a circumferential surface for carrying thereon developer containing toner and magnetic carrier, the stationary magnet having a plurality of magnetic poles arranged in a circumferential direction of the sleeve, and the developing roller being disposed at a predetermined developing position at which the developing roller faces a photoconductive drum having a surface for allowing an electrostatic latent image to be formed thereon, to supply toner to the photoconductive drum;

a developer conveying section disposed below the developing roller in the housing for circularly conveying developer; and a conveying screw disposed in the developer conveying section and facing the developing roller at a predetermined facing position, the conveying screw being rotatable to convey developer in an axial direction of the developing roller to supply developer to the developing roller, wherein:

the stationary magnet includes a separation pole for producing a magnetic field that causes separation of developer from the sleeve;

the housing includes a standing wall disposed downstream of the developing position in a rotational direction of the sleeve and facing the developing roller, the standing wall being formed with at least one opening that faces the separation pole in a horizontal direction, the developing device further comprising at least one filter section disposed on one side surface of the standing wall that is opposite to the other side surface facing the developing roller, the at least one filter section covering the at least one opening;

the developer conveying section includes a first stirring portion in which the conveying screw is disposed, and a second stirring portion adjacent to the first stirring portion;

the housing includes a partition plate extending in an axial direction of the developing roller and dividing the first stirring portion from the second stirring portion; and a lower end of the standing wall is connected to an upper end of the partition plate so that toner scattered from the second stirring portion is prevented from reaching the filter section.

16. An image forming apparatus, comprising:

the developing device according to claim 15;

the photoconductive drum for receiving toner supplied from the developing device and having a circumferential surface for carrying a toner image thereon; and a transfer section for transferring the toner image from the photoconductive drum onto a sheet.

* * * * *